United States Patent [19]

Crowley

[11] 4,078,354

[45] Mar. 14, 1978

[54] METHOD OF CONSTRUCTING A CONCRETE TANK JOINT

[76] Inventor: Francis X. Crowley, 24 Lanark Rd., Wellesley, Mass. 02181

[21] Appl. No.: 765,356

[22] Filed: Feb. 3, 1977

[51] Int. Cl.[2] ..... E04H 7/20; E04H 12/16

[52] U.S. Cl. ..... 52/744; 52/224; 52/247; 52/248; 52/169.7; 52/264

[58] Field of Search ..... 52/248, 247, 246, 259, 52/245, 169.7, 224, 227, 223, 264, 744

[56] References Cited

U.S. PATENT DOCUMENTS

| | | | |
|---|---|---|---|
| 2,932,964 | 4/1960 | Dobell | 52/247 |
| 3,233,376 | 2/1966 | Naillon | 52/264 |
| 3,300,916 | 1/1967 | Pritzker | 52/246 |
| 3,824,751 | 7/1974 | Shelander | 52/245 |

*Primary Examiner*—John E. Murtagh

[57] ABSTRACT

A wall-base joint for a concrete tank is constructed by providing in a base a groove larger than the width of a tank wall, placing the wall in the groove to leave a groove portion on each side of the wall, prestressing the wall with a first compressive force, filling the inner (with respect to the center line of the base) groove portion with concrete and curing it to form a first plug therein, prestressing the wall further with a second compressive force to counteract a fraction of the bending moments produced by the liquid in the tank when it is full, and filling the outer groove portion with concrete and curing it to form a second plug to lock the inner plug into permanent compression.

8 Claims, 2 Drawing Figures

FIG 1
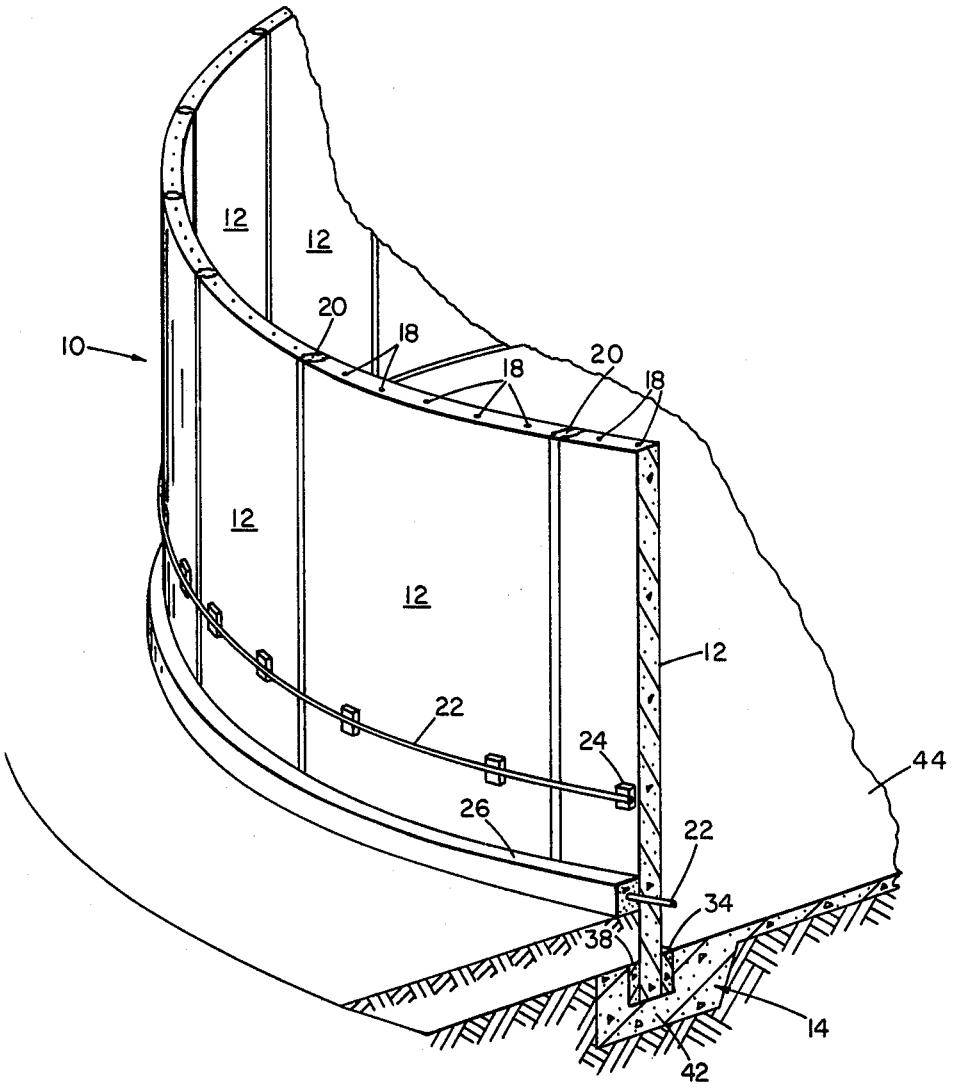
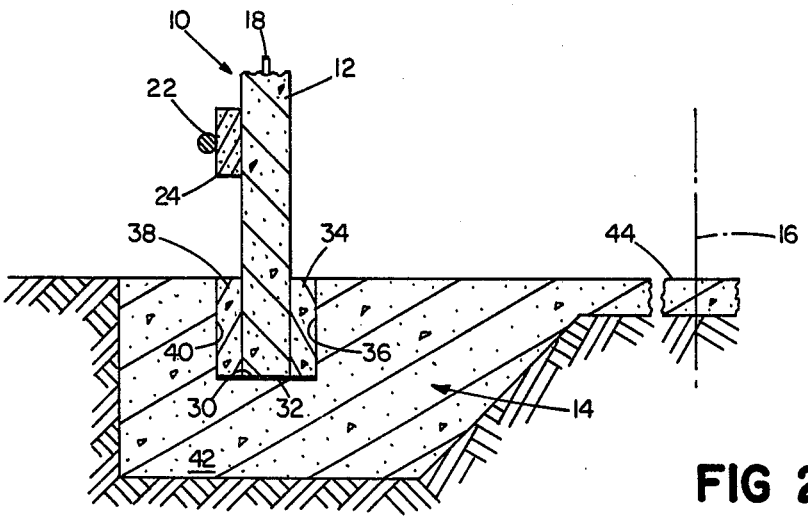
FIG 2

METHOD OF CONSTRUCTING A CONCRETE TANK JOINT

FIELD OF THE INVENTION

This invention relates to prestressed concrete tanks.

BACKGROUND OF THE INVENTION

In the art of constructing a prestressed concrete tank in which, for example, wires are wrapped around the tank wall to put it into compression before any liquid is put into the tank, one problem has been the design of a satisfactory joint between the wall and the base of the tank. One way of making the joint was simply to fasten the wall rigidly to the base, for example, by cementing the wall into a groove in the base prior to any prestressing. However, the great forces needed for prestressing would create large bending moments in the wall before liquid was put into the tank, and the wall might crack. Another joint was made by placing the wall on a rubber pad on the base. The problem of buildup of excessive bending moments in the wall was eliminated because the wall could move inward against the elastic pad on prestressing and move back outward when the tank was filled. Such a joint is shown in Dobell U.S. Pat. No. 2,932,964. Unlike the case with the rigid joint, however, in the pad joint the base did not help to hold the wall against the pressure of the liquid, and the wall would move radially as the tank was emptied and refilled.

SUMMARY OF THE INVENTION

I have discovered that a wall-base tank joint may be constructed that will avoid buildup of excessive bending moments in the tank wall while providing for base support for the wall against the force of the liquid by providing in the base a groove larger than the width of the tank wall and having a low-friction groove upper surface, placing the wall in the groove to leave a groove portion on each side of the wall, prestressing the wall with a first compressive force, filling at least lower portions of the inner (with respect to the center line of the base) groove portion with concrete and curing it to form a first plug therein, prestressing the wall further with a second compressive force, and filling at least lower portions of the outer groove portion with concrete and curing it to form a second plug to lock the inner plug into permanent compression. When liquid is put into the tank, the second plug is put into compression to provide a horizontal force in addition to the first and second compressive forces to resist tensile forces on the wall imparted by the liquid as well as to provide a further seal against leakage, the first plug remaining in compression and providing a seal as well. In the invention no bending moments in the wall are produced by the first prestressing, and only enough bending moments are produced by the second prestressing to counteract a fraction (ideally one-half) of the bending moments produced by the liquid when the tank is full.

The invention allows use of thinner tank walls and less prestressing steel because of the minimization of bending moments resulting from prestressing.

PREFERRED EMBODIMENT

I turn now to description of a presently preferred embodiment of the invention.

DRAWINGS

FIG. 1 is a view in perspective of a portion of a tank embodying the invention, the tank being in an intermediate stage of construction; and FIG. 2 is a vertical sectional view through the tank of FIG. 1 with concrete beam and some of the earth removed.

DESCRIPTION

The embodiment shown in the drawings and its method of construction and operation are now described.

1. Embodiment

FIGS. 1 and 2 show a portion of a circular tank wall 10 made up of several concrete panels 12 mounted in a circular concrete base 14 having a center line 16. Each of the panels contains a series of vertical prestressing tendons 18. Cast concrete filler units 20 fill the spaces between adjacent panels. Reinforcing steel wires 22 separated from the panels and filler units by horizontal rows of concrete brick spacers 24 are wrapped around wall 10. Other than the joint between wall 10 and base 14, further details of the manner and nature of construction of the tank, including its completion by the addition of concrete beams 26 surrounding reinforcing wires 22 and, if desired, a top, are given in my copending U.S. patent application Ser. No. 576,121, now U.S. Pat. No. 4,015,383 entitled "Concrete Tank of Precast Concrete Panels with Pretensioned Beam Means" filed May 9, 1975, which is hereby incorporated by reference herein.

Base 14 has an annular groove 28, which receives wall 10, precast therein. Bottom 30 of groove 28 is provided with a slippery surface 32 of polyethylene lubricated with silicone. Inner plug 34 is an annulus of cast concrete that fills that part of groove 28 between wall 10 and inner groove wall 36. Outer plug 38, also an annulus of cast concrete, fills that part of groove 28 between wall 10 and outer groove wall 40. Inner plug 34 is in permanent compression; outer plug 38 is in compression when the tank has water in it.

Regarding dimensions, base 14 has an outer footing 42 that is 2 feet deep and 3 feet wide, then slopes upwardly 45° until it levels off to provide a 4 inch deep floor 44. Wall 10 is 6 inches wide, plug 34 is 3 inches wide, and plug 38 is 3 inches wide. Groove 28 is 12 inches by 12 inches in cross section.

2. Method of Construction and Operation

Prior to being arranged to form wall 10, panels 12 are vertically prestressed through tendons 18. Base 14 is prepared with groove 28, and slippery surface 32 is formed on groove bottom 30. Wall 10 is then constructed from panels 12 and filler units 20 in groove 28, leaving inner and outer unfilled groove portions on either side of the wall. Some reinforcing steel wires 22 are then wound about spacers 24 on wall 10 as set forth in my said copending application Ser. No. 576,121 in order to prestress the wall by putting it into compression, the forces directed generally toward center line 16. Slippery surface 32 facilitates inward movement of wall 10 under this compression, during which no bending moments are imparted to wall 10 because of the absence of restraint by the base owing to room for inward movement afforded by the inner groove portion. Inner plug 34 is then cast and hardened in the inner groove portion. Further reinforcing wires 22 are wound on wall 10 to complete prestressing, with forces again directed toward center line 16; the force of this second winding is calculated to produce bending moments equal and opposite to one-half those caused by the water when the tank is full. Inner plug 34 is by this winding also put into compression. Outer concrete plug 38 is then poured into the outer groove portion and cured, thereby locking inner plug 34 into permanent compression. The tank is then filled with water, which puts outer plug 38 under compression. Outer plug 38 and base 14 through plug 38 assist wires 22 in resisting tensile forces on wall 10 imparted by the water. Because inner plug 34 is permanently in compression and outer plug 38 is in compression when there is water in the tank, both plugs and wall 10 cooperate with groove 28 to provide a tight seal against leakage of water. My invention provides the additional advantage, during construction of precast tanks, that after the tops of the concrete panels are tied into a cylinder with weld plates, wedges may be used in the grooves to stabilize the panels so that knee braces can be removed.

The force from the first winding and the force from the second winding may probably be proportioned, in a manner that may be calculated using a computer, to give further optimization. Height of the plugs, and shape and location of the plug walls, and base dimensions may be varied to affect rotational forces at the joint and thus bending moments in the wall.

Other embodiments will be obvious to those skilled in the art.

What is claimed is:

1. A method of constructing a wall-base joint for a concrete tank comprising the steps of:

providing a concrete base having a center line and a groove formed therein about said center line, positioning a concrete tank wall in said groove, said wall being thinner than the width of said groove, so that a groove portion remains on either side of said wall, applying first compressive forces to said wall directed generally inwardly toward said center line, forming a first plug of concrete in said groove portion located on the side of said wall closer to said center line, applying second compressive forces to said wall and to said first plug directly generally inwardly toward said center line, and forming a second plug of concrete in said remaining groove portion, thereby to lock said first plug into permanent compression.

2. The method of claim 1 including the first step of putting liquid in said tank after forming said second plug, thereby to put said second plug into compression.

3. The method of claim 1 wherein applying said first compressive forces produces no bending moments in said wall.

4. The method of claim 1 including the step done before said positioning step of constructing said wall from a plurality of vertically prestressed concrete panels.

5. The method of claim 3 wherein applying said second compressive forces produces bending moments equal and opposite to one-half those caused by liquid in said tank when it is full.

6. The method of claim 1 further including the step done before positioning said wall in said groove of making said groove bottom slippery, thereby to permit said wall to move in said groove in response to compression.

7. The method of claim 1 wherein said applying steps are done by winding metal reinforcing means around said tank wall.

8. The method of claim 7 wherein said metal reinforcing means are wires.

* * * * *